US007726596B2

(12) United States Patent
Kraft et al.

(10) Patent No.: US 7,726,596 B2
(45) Date of Patent: Jun. 1, 2010

(54) REFINER WITH SPIRAL INLET AND DUAL TANGENTIAL DISCHARGE OUTLET

(75) Inventors: Michael Kraft, Montoursville, PA (US); Julie Ruch, Watsontown, PA (US)

(73) Assignee: Andritz Inc., Glens Falls, NY (US)

( * ) Notice: Subject to any disclaimer, the term of this patent is extended or adjusted under 35 U.S.C. 154(b) by 148 days.

(21) Appl. No.: 12/054,931

(22) Filed: Mar. 25, 2008

(65) Prior Publication Data

US 2008/0272216 A1 Nov. 6, 2008

Related U.S. Application Data

(60) Provisional application No. 60/915,802, filed on May 3, 2007.

(51) Int. Cl.
*B02C 7/11* (2006.01)

(52) U.S. Cl. ..... 241/248; 241/261.2; 241/297

(58) Field of Classification Search ..... 241/244–248, 241/261.2, 261.3, 296–298
See application file for complete search history.

(56) References Cited

U.S. PATENT DOCUMENTS 4,132,366 A * 1/1979 Engall ..... 241/245
4,326,913 A 4/1982 Mattsson
4,378,092 A 3/1983 Reinhall
5,445,328 A 8/1995 Musselman
6,053,440 A 4/2000 LaRiviere
RE39,688 E 6/2007 LaRiviere
2006/0175447 A1* 8/2006 Duggan ..... 241/261.2

FOREIGN PATENT DOCUMENTS

GB 1 404 747 9/1975

* cited by examiner

*Primary Examiner*—Mark Rosenbaum
(74) *Attorney, Agent, or Firm*—Nixon & Vanderhye P.C.

(57) ABSTRACT

A fibrous slurry refiner includes a casing, a rotor secured to a rotor shaft, and first and second pluralities of grinding surfaces. The rotor is disposed within the casing and is rotatable via the rotor shaft. The first plurality of grinding surfaces is secured to the rotor, and the second plurality of grinding surfaces is disposed facing the first plurality of grinding surfaces and fixed in the casing. An inlet plate for each of the plurality of grinding surfaces directs the fibrous slurry toward a set of facing first and second grinding surfaces and imparts a rotary flow to the fibrous slurry.

8 Claims, 4 Drawing Sheets

REFINER WITH SPIRAL INLET AND DUAL TANGENTIAL DISCHARGE OUTLET

CROSS-REFERENCES TO RELATED APPLICATIONS

This application claims the benefit of U.S. Provisional Patent Application Ser. No. 60/915,802, filed May 3, 2007, the entire content of which is herein incorporated by reference.

STATEMENT REGARDING FEDERALLY SPONSORED RESEARCH OR DEVELOPMENT (Not Applicable)

BACKGROUND OF THE INVENTION

The present invention relates to a refiner for refining a fibrous slurry and, more particularly, to a refiner including inlet and outlet structure that effects better performance.

Refiners for a fibrous slurry are used for developing fiber to increase surface area and fibrils and for cutting fibers to reduce their length. Low consistency refining was generally understood with respect to lignocellulosic material, as referring to a refiner fed by pumped slurry having a consistency of about 2-5% fiber. Modern pumping techniques accommodate consistency up to about 16% fiber (sometimes referred to as "medium consistency"). In these types of refiners, flow control is accomplished on the discharge of the machine by a single throttling valve in a single discharge line. This is in contrast to the control of so-called high consistency refiners, where the feed is metered by a device upstream of the refiner.

Conventional two zone refiners maintain a common discharge from both refining zones and therefore, small differences in the refiner plate bar depth between the two zones or other factors can change the relative pumping capability of each zone. This can result in one zone pulling more than one-half of the total flow being supplied to the refiner, which then provides uneven refining in the two zones since the thrust in the zones and the power applied is equal. Another deficiency is that the zone with the lower flow will have a smaller operating gap and therefore have a greater tendency for plate contact and increased wearing of the refining plate surfaces. This problem of uneven flow is particularly noticeable at material flows that are at the minimum volumetric capacity of the machine where operation may be desirable due to the lower refining intensities available at the lower flows.

Conventional refiners additionally require space between an inlet and the grinding surfaces in order to accelerate the slurry for processing. The required space reduces the effective work area of the machine.

BRIEF SUMMARY OF THE INVENTION

It would be desirable to accelerate the incoming flow more closely to the geometry of the rotating plates of the refiner. It would also be desirable to distribute the incoming flow such that it is more uniformly distributed annularly around the inner periphery of the refining zone. It would also be desirable to configure the refiner discharge such that there would be minimal acceleration required to discharge the slurry flow.

In an exemplary embodiment, a fibrous slurry refiner includes a casing, a rotor secured to a rotor shaft, the rotor being disposed within the casing and rotatable via the rotor shaft, and a first plurality of grinding surfaces secured to the rotor and a second plurality of grinding surfaces disposed facing the first plurality of grinding surfaces and being fixed in the casing. An inlet housing made up of an inlet plate, an axial cylinder and a spiral inlet opening for each of the plurality of grinding surfaces directs the fibrous slurry toward a set of facing first and second grinding surfaces and imparts a rotary flow to the fibrous slurry. The inlet axial cylinder is preferably substantially circular, wherein a spiral inlet opening is positioned tangentially relative to a center of inlet plate. The inlet housing may include a spiral channel extending from the inlet opening to the center of the inlet plate. In this context, the center of the inlet defines an axial channel that directs the fibrous slurry toward the grinding surfaces.

The refiner may include a first set of first and second grinding surfaces on one side of the casing and a second set of first and second grinding surfaces on an opposite side of the casing, wherein the refiner includes a pair of inlet plates, one on each side of the casing. In this regard, the casing may include a pair of outlet channels, one on each side of the casing, the outlet channels being positioned to receive flow from the grinding surfaces. The outlet channels are preferably configured to minimize a disturbance on the casing caused by discharge of the flow. In this context, the pair of outlet channels may be substantially volumetrically equal. In one arrangement, the casing includes a substantially circular housing disposed surrounding the grinding surfaces, wherein the outlet channels are defined along an outer circumference of the substantially circular housing.

In another exemplary embodiment, an inlet plate for a fibrous slurry refiner includes an inlet opening that imparts a rotary flow to the fibrous slurry.

In yet another exemplary embodiment, a casing for a fibrous slurry refiner includes a pair of outlet channels, one on each side of the casing, wherein the outlet channels are configured to minimize a disturbance on the casing caused by discharge of a refined slurry.

In still another exemplary embodiment, a method of refining a fibrous slurry in a refiner includes the steps of flowing the fibrous slurry through a pair of inlet plate openings; accelerating and imparting rotary flow to the fibrous slurry via the inlet housing; directing the accelerated and rotary flow fibrous slurry to a plurality of grinding surfaces; and refining the fibrous slurry with the grinding surfaces.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
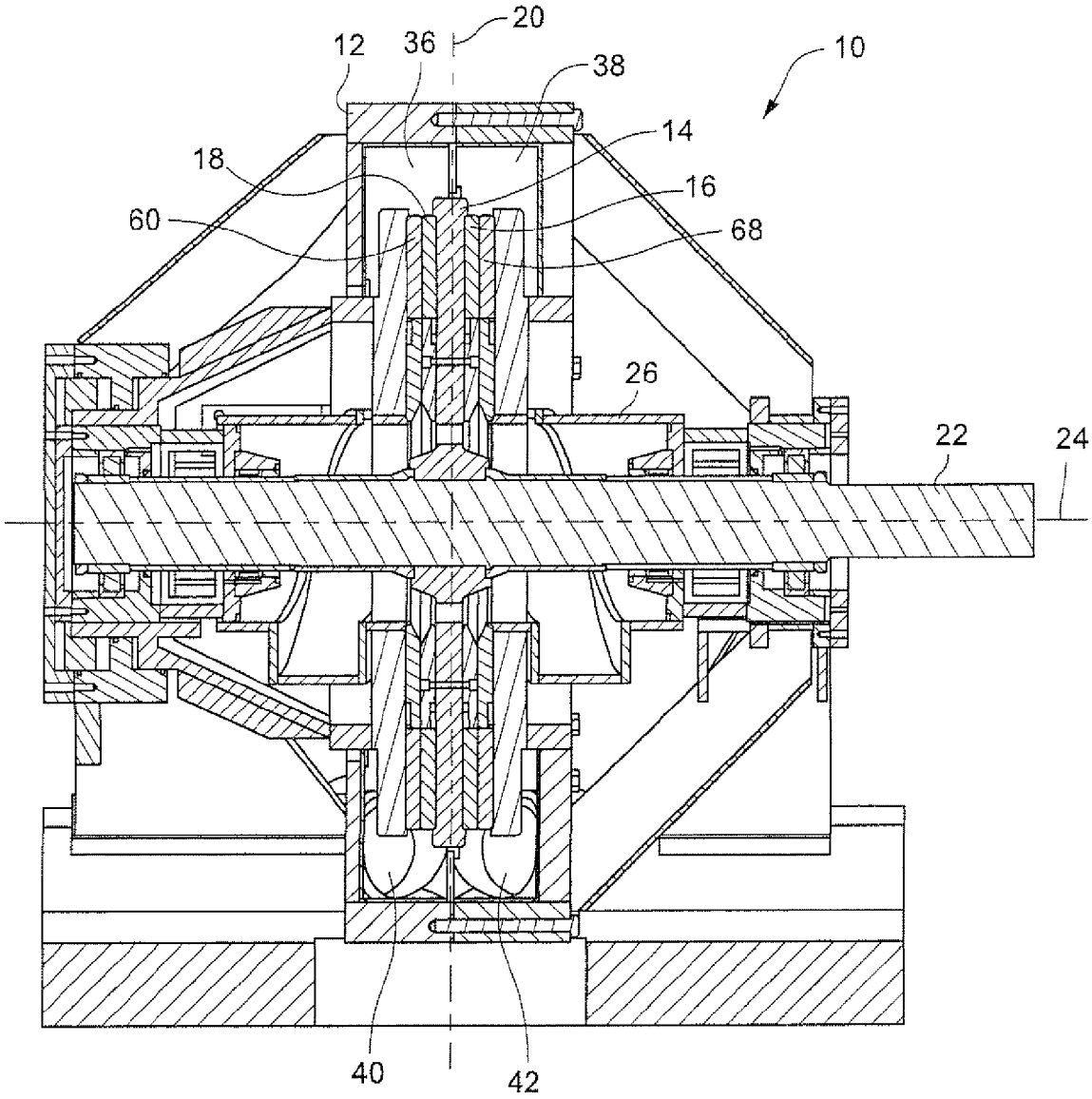
FIG. 1 is a cross-sectional view of the refiner.

It should be understood that the present invention is applicable to a variety of refiners for mechanically treating a slurry of fibrous material, wherein the machine has at least two refining zones located substantially symmetrically on either side of a vertical plane perpendicular to the refiner shaft. A refiner 10 of this type is shown in FIG. 1. A casing 12 has a substantially flat rotor 14 situated therein, the rotor carrying a first annular plate defining a first grinding surface 16 and a second annular plate defining a second grinding surface 18, each disposed in facing relation with third and fourth grinding surfaces 68, 60 respectively. A shaft 22 extends horizontally about a rotation axis 24 and is driven at one or both ends (not shown) in a conventional manner. The refiner in FIG. 1 is in all respects pertinent to this disclosure symmetric about plane 20, and therefore any structure described herein on one side of the plane has counterpart structure on the other side of the plane.

Figure 2:
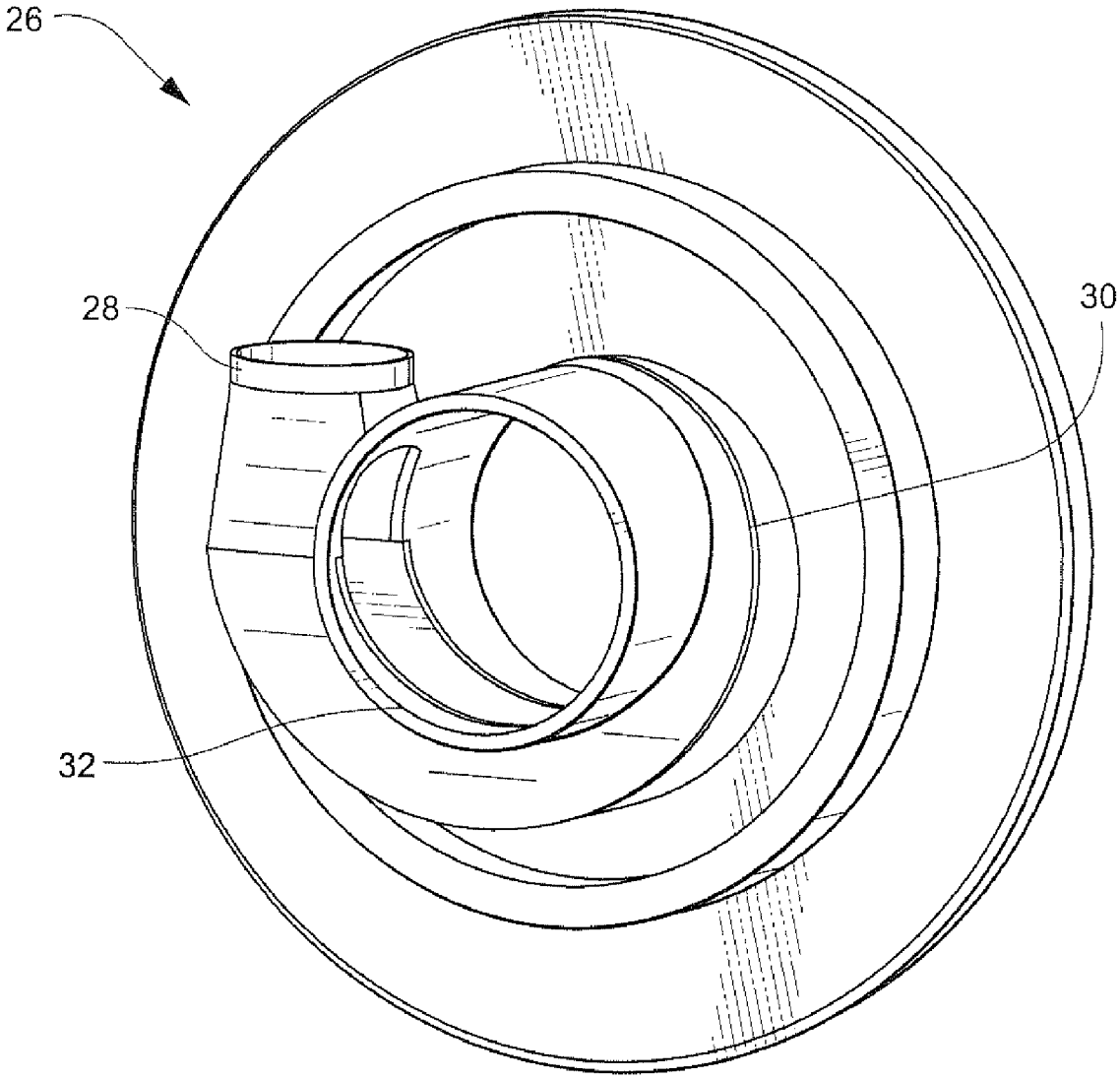
FIG. 2 is a perspective view of an inlet plate.
Figure 4:
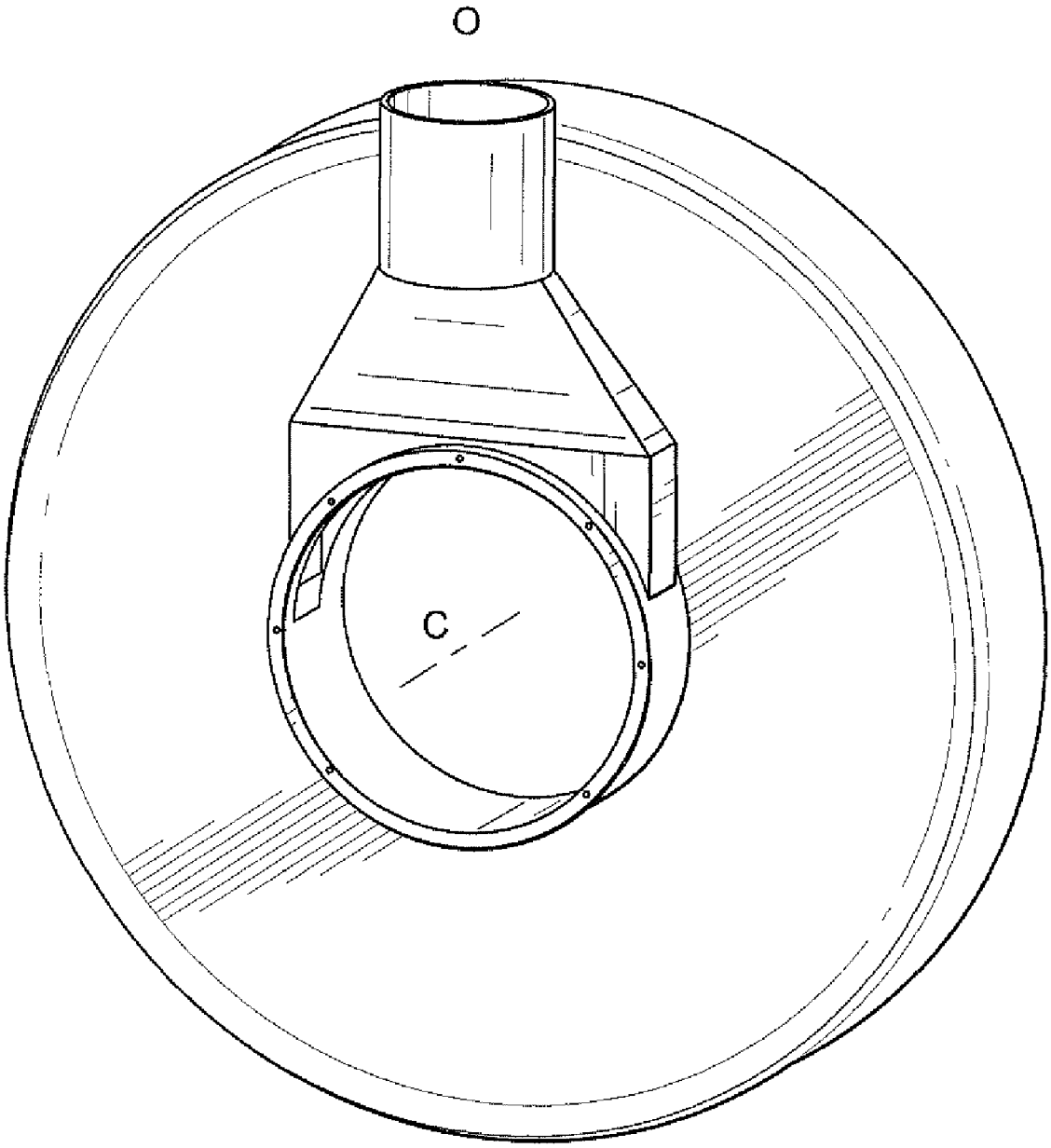
FIG. 4 illustrates a conventional inlet plate.

An inlet plate 26 is provided on each side of the plane 20. The inlet plates 26 direct the fibrous slurry toward the grinding surfaces 16, 18 and facing grinding surfaces 68, 60. FIG. 2 is a perspective view of the inlet plate 26. As shown, the inlet plate is substantially circular. Unlike the conventional inlet plate construction, the inlet plate 26 described herein includes an inlet opening 28 that is positioned tangentially relative to a center of the inlet plate 26. In contrast, in the conventional construction shown in FIG. 4, the inlet opening O is aligned with a center C of the plate. The inlet opening 28 described herein is offset from the center along a tangent of the plate circular shape. A channel 30 in a spiral or voluted shape extends from the inlet opening 28 to the center of the inlet plate 26. The voluted channel 30 serves to accelerate the fibrous slurry and impart a rotary flow. The center of the inlet plate 26 defines an axial channel 32 that directs the accelerated and rotary flow fibrous slurry toward the grinding surfaces In this manner, the inlet plates 26 serve to expand an effective work area of the machine. That is, with the conventional structure, space is required to accelerate the pulp before reaching the grinding surfaces. With the inlet opening 28 on a tangent of the inlet plate 26 in conjunction with the voluted channel 30, the inlet plate 26 imparts a centrifugal velocity and rotary flow to the slurry, thereby improving the performance of the refiner.

Figure 3:
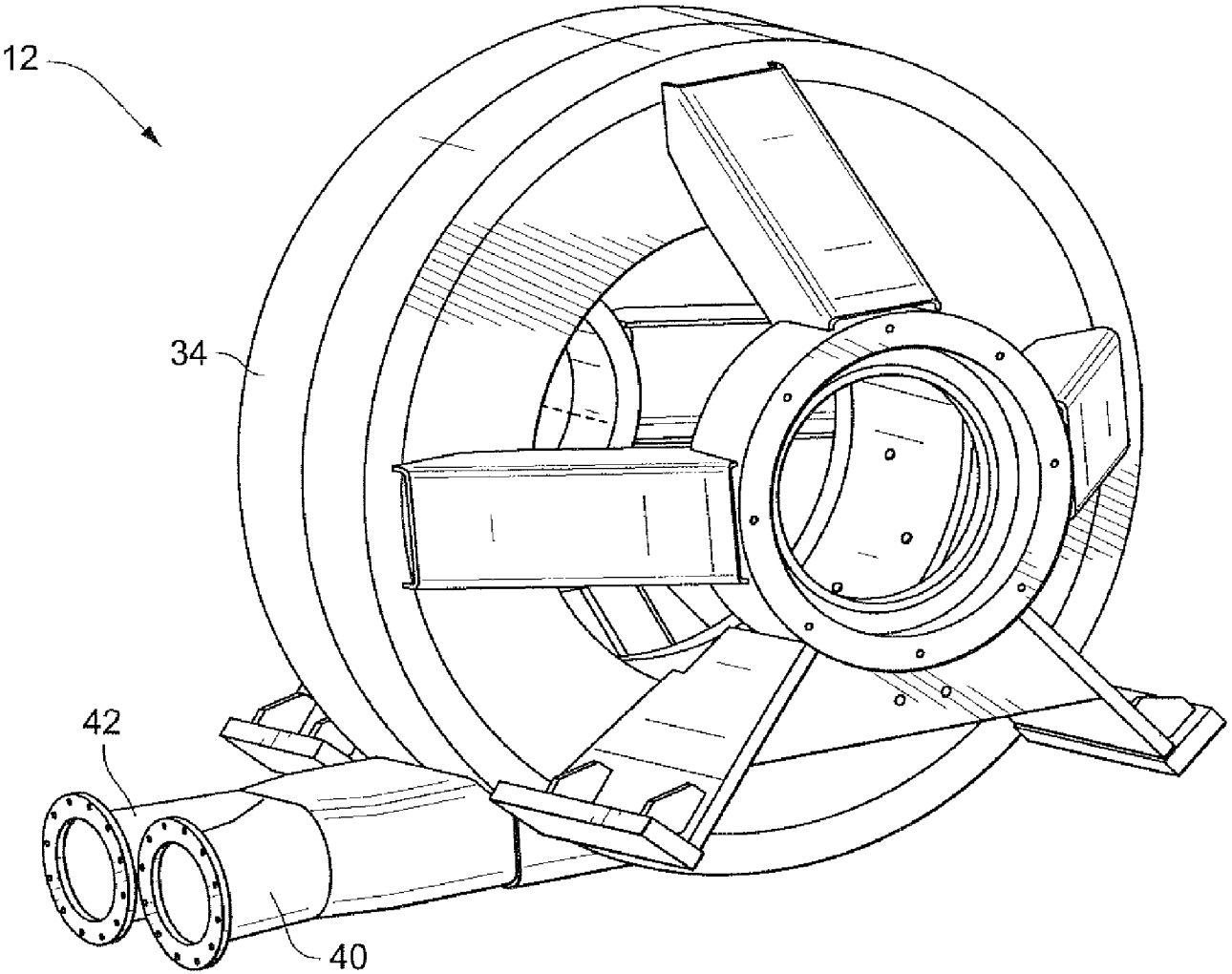
FIG. 3 is a perspective view of the refiner casing.

With reference to FIGS. 1 and 3, the casing 12 includes a substantially circular housing 34, which surrounds the rotor and grinding surface assembly. The circular housing 34 includes a pair of outlet channels 36, 38, one on each side of the casing 12. The outlet channels 36, 38 are defined along an outer circumference of the substantially circular housing 34. The outlet channels 36, 38 receive flow from the grinding surfaces tangentially and direct the flow along the outer circumference of the substantially circular housing 34 to a pair of discharge outlets 40, 42. The outlet channels 36, 38 and discharge outlets 40, 42 are preferably substantially volumetrically equal to minimize a disturbance on the casing caused by discharge of the flow. Additionally, the tangential orientation of the outlet channels 36, 38 and discharge outlets 40, 42 further minimizes the disturbance on the machine by the exiting flow. If the machine construction can maintain equal forces on opposite sides, performance of the machine can be maximized.

With the structure and operation of the refiner described herein, the dual inlet plate design serves to maximize available edge length and additionally keeps pulp inlet flow velocities within limits while fitting within a reasonable geometry window. Moreover, the dual inlets prevent suspected side-to-side dewatering effects through disc rotor ports. The tangential inlet configuration facilitates optimization of pulp flow to the inner diameter without re-acceleration of pulp and potential dewatering. Moreover, the configuration allows spiral inlet geometry in two planes to accommodate space necessary to reinforce plate holder for low deflections. The tangential and circumferential discharge configuration facilitates a force equilibrium on opposite sides of the casing, thereby improving refiner performance.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A fibrous slurry refiner comprising:

a casing;

a rotor secured to a rotor shaft, the rotor being disposed within the casing and rotatable via the rotor shaft;

a first plurality of grinding surfaces secured to the rotor;

a second plurality of grinding surfaces disposed facing the first plurality of grinding surfaces and being fixed in the casing; and an inlet housing made up of an inlet plate, an axial cylinder and a spiral inlet opening for each of the plurality of grinding surfaces, each inlet plate directing the fibrous slurry toward a set of facing first and second grinding surfaces and imparting a rotary flow to the fibrous slurry, wherein the axial cylinder is substantially circular, wherein the spiral inlet opening is positioned tangentially relative to a center of inlet plate, and wherein the inlet housing comprises a spiral channel extending from the inlet opening to the center of the inlet plate.

2. A fibrous slurry refiner according to claim 1, wherein the center of the inlet plate defines an axial channel that directs the fibrous slurry toward the grinding surfaces.

3. A fibrous slurry refiner according to claim 1, comprising a first set of first and second grinding surfaces on one side of the casing and a second set of first and second grinding surfaces on an opposite side of the casing, wherein the refiner includes a pair of inlet plates, one on each side of the casing.

4. A fibrous slurry refiner according to claim 3, wherein the casing comprises a pair of outlet channels, one on each side of the casing, the outlet channels being positioned to receive flow from the grinding surfaces.

5. A fibrous slurry refiner according to claim 4, wherein the outlet channels are configured to minimize a disturbance on the casing caused by discharge of the flow.

6. A fibrous slurry refiner according to claim 5, wherein the pair of outlet channels are substantially volumetrically equal.

7. A fibrous slurry refiner according to claim 6, wherein the casing comprises a substantially circular housing disposed surrounding the grinding surfaces, and wherein the outlet channels are defined along an outer circumference of the substantially circular housing.

8. A fibrous slurry refiner according to claim 4, wherein the casing comprises a substantially circular housing disposed surrounding the grinding surfaces, and wherein the outlet channels are defined along an outer circumference of the substantially circular housing.

* * * * *